US009530593B1

(12) United States Patent
Fasano

(10) Patent No.: US 9,530,593 B1
(45) Date of Patent: Dec. 27, 2016

(54) ELECTROMAGNETICALLY ASSISTED ARC QUENCH WITH PIVOTING PERMANENT MAGNET

(71) Applicant: Michael Fasano, Watertown, CT (US)

(72) Inventor: Michael Fasano, Watertown, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 14/830,382

(22) Filed: Aug. 19, 2015

(51) Int. Cl.
*H01H 33/18* (2006.01)

(52) U.S. Cl.
CPC ..... *H01H 33/182* (2013.01)

(58) Field of Classification Search
CPC .... H01H 9/443; H01H 33/182; H01H 33/596; H01H 50/08; H01H 50/541; H01H 51/00; H01H 51/2227; H01H 9/346; H01H 9/36; H01H 1/20; H01H 1/2025; H01H 1/2041; H01H 2050/025; H01H 29/004; H01H 33/10; H01H 50/546; H01H 9/34; H01H 71/142; H01H 71/56; H01H 1/2058; H01H 33/121; H01H 33/161; H01H 3/222; H01H 71/40; H01H 77/10
See application file for complete search history.

(56) References Cited

U.S. PATENT DOCUMENTS 3,946,346 A * 3/1976 Oster ..... H01H 9/42 335/16
5,164,693 A * 11/1992 Yokoyama ..... H01H 9/46 335/14
5,252,933 A * 10/1993 Kamino ..... H01H 89/08 335/172
2007/0171016 A1* 7/2007 Bonjean ..... H01H 33/6662 335/234
2012/0037598 A1 2/2012 Fasano
2012/0261382 A1 10/2012 Fasano
2013/0264311 A1* 10/2013 Lang ..... H01H 1/2025 218/2
2013/0313228 A1* 11/2013 Friedrichsen ..... H01H 1/20 218/23
2014/0061160 A1* 3/2014 Juds ..... H01H 9/443 218/26
2014/0284310 A1* 9/2014 Gerving ..... H01H 9/36 218/26
2015/0048908 A1* 2/2015 Isozaki ..... H01H 1/54 335/6
2015/0070114 A1* 3/2015 Fasano ..... H01H 71/32 335/21
2015/0114934 A1* 4/2015 Juds ..... H01H 33/08 218/149

* cited by examiner

*Primary Examiner* — Truc Nguyen
(74) *Attorney, Agent, or Firm* — St. Onge Steward Johnston & Reens, LLC

(57) ABSTRACT

A circuit interrupter configured to aid in rapidly extinguishing an electrical arc regardless of the polarity of current through a circuit interrupter, and during low current conditions. Various implementations of the circuit interrupter incorporate an electromagnet and a pivoting permanent magnet. These structures produce additive magnetic fields that create a force on an arc between the contacts, urging it toward an arc arresting structure regardless of the electrical polarity of the circuit interrupter or the magnitude of the current through the circuit interrupter.

15 Claims, 12 Drawing Sheets

ELECTROMAGNETICALLY ASSISTED ARC QUENCH WITH PIVOTING PERMANENT MAGNET

FIELD OF THE INVENTION

The present invention relates generally to the protection of electrical devices, and more specifically, relates to arc extinguishing structures that are configured to aid in rapidly extinguishing an electrical arc regardless of the polarity of current through a circuit interrupter, and during low current conditions.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, leads out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However circuit breakers may be safer to use in some circumstances than fuses, and may be easier to fix.

In a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from a closed position to an open position.

As the contacts begin to separate from the closed position, or approach complete closure from an open position, a very small gap exists between the contacts for a brief time while the contacts are closed or opened. An electric arc may be generated across this gap if the voltage between the contacts is high enough. This is because the breakdown voltage between the contacts is positively related to distance under certain pressure and voltage conditions.

The creation of an arc during switching or tripping the circuit interrupter can result in undesirable side effects which can negatively affect the operation of the circuit interrupter, and which can create a safety hazard.

These effects can have consequences for the operation of the circuit interrupter.

One possible consequence is that the arc may short to other objects in the circuit interrupter and/or to surrounding objects, causing damage and presenting a potential fire or electrocution safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius) which can crack the surrounding gas molecules, creating ozone, carbon monoxide, and other compounds. The arc can also ionize the surrounding gasses, potentially creating alternate conduction paths.

Because of these detrimental effects of arcing, it can be very important to quickly cool and quench the arc to prevent damage to the circuit interrupter.

Various techniques for improved arc quenching are known. For example, U.S. Patent Application Publications No. 2012/0037598 and 2012/0261382, assigned to Carling Technologies, Inc., relate to the use of an electromagnetic field to guide the arc toward an arc splitter.

However, generating an electromagnetic field to move the arc consumes power, and generates heat in the device, limiting the applicability of this approach. In addition, the strength of the electromagnetic field depends upon the current flowing through the circuit interrupter, and may not be great enough to sufficiently affect the arc under certain conditions. For example, in some applications a critical current interruption may be required at a low current that would not generate a strong enough electromagnetic field to drive the arc into the arc extinguishing structure, or would require an impractical electromagnet design.

One possible approach to this problem is to incorporate a permanent magnet, which produces a magnetic field without requiring a supply of current. But permanent magnets produce a magnetic field having a fixed direction with respect to the orientation of the magnet, and independent of the current flow through the circuit breaker. Thus, many known solutions for guiding an arc into an arc path using a permanent magnet are dependent on the electrical polarity of the circuit. This is because the direction in which the arc is moved by the fixed magnetic field depends upon the direction the current is flowing through the circuit interrupter.

This can be a significant limitation, because it prevents such devices from being installed in a circuit where the electrical polarity may be reversed. Hazardous conditions may also arise in a situation where such a device is accidentally installed backwards, because the magnetic field ordinarily used to enhance arc quenching will in fact operate to drive the arc away from the arc path. This sensitivity to electrical polarity also precludes permanent magnet solutions from being used in alternating current applications, where the electrical polarity reverses repeatedly.

Recent developments in arc quenching technology have yielded solutions to some of these limitations including an arrangement, which utilizes a permanent magnet that guides the arc toward an arc splitter in a way that is not sensitive to the electrical polarity of the circuit.

However, these arrangements can require the addition of specialized structures into the circuit breaker and may therefore be impractical for certain applications or from the standpoint of design re-use, retrofitting, or upgrade of existing designs. Such arrangements also incorporate a magnetic field having a fixed strength, which does not have the advantage of increasing with current as in electromagnetic designs.

Thus, it is desirable to combine the low current arc arresting of permanent magnet solutions with the electrical polarity independence and increasing field strength of electromagnet solutions.

SUMMARY OF THE INVENTION

Accordingly, it is an object of the present invention to provide a circuit interrupter having a magnetic field to urge an arc between the contacts into an arc extinguishing structure.

It is a further object of the invention to provide a magnetic field which urges the arc into the arc extinguishing structure regardless of the electrical polarity of the circuit interrupter.

It is yet a further object of the invention to provide a magnetic field having a minimum strength regardless of the amount of current flowing through the circuit interrupter.

Objects of the invention are achieved by providing a circuit interrupter having a first contact and a second contact, at least one of which is movable with respect to the other; a first conductor electrically connected to the first contact; a second conductor electrically connected to the second contact; an arc extinguisher; an electromagnetic structure disposed to urge an arc between the contacts when they are out of contact, toward the arc extinguisher regardless of the polarity of the contacts; and, a permanent magnet disposed within a core of the electromagnetic structure; wherein the permanent magnet pivotably orients with respect to a field produced by the electromagnetic structure; and, wherein the permanent magnet is disposed urge an arc between the contacts, when they are out of contact, toward the arc extinguisher regardless of a polarity of the contacts.

Further, objects of the invention are achieved by providing a circuit interrupter having a first contact and a second contact, at least one of which is movable with respect to the other; a first conductor electrically connected to the first contact; a second conductor electrically connected to the second contact; an arc extinguisher; an electromagnetic structure disposed to urge an arc between the contacts when they are out of contact, toward the arc extinguisher regardless of the polarity of the contacts; and, a permanent magnet disposed to urge an arc between the contacts, when they are out of contact, toward the arc extinguisher regardless of a polarity of the contacts.

In some implementations, the permanent magnet is at least partly disposed within the electromagnetic structure.

In some implementations, the permanent magnet is oriented by an electromagnetic field. The electromagnetic field may be produced by the electromagnetic structure.

In some implementations, the permanent magnet is disposed such that a field of the permanent magnet flows through an area where the first contact and second contact move into and out of contact with each other.

In some implementations, the electromagnetic structure includes an electromagnet.

In some implementations, the electromagnetic structure includes a conductor wrapped around a core. The permanent magnet may be disposed within the core, and the permanent magnet may be pivotable within the core.

In some implementations, an electromagnetic field produced by the electromagnetic structure can orient the permanent magnet.

In some implementations, the electromagnetic structure includes the first electrical conductor and the second electrical conductor. A current flowing through the first conductor may run in a direction substantially opposite to a direction in which the current flows through the second conductor, and current flowing through the first conductor, the first contact, the second contact, and the second conductor may generate a magnetic force which urges the arc toward said arc extinguisher.

Further, objects of the invention are achieved by providing a circuit interrupter having a first contact and a second contact, at least one of which is movable with respect to the other; a first conductor electrically connected to the first contact; a second conductor electrically connected to the second contact; an arc extinguisher; and a magnetic field disposed to urge an arc between the contacts, when they are out of contact toward the arc extinguisher regardless of a polarity of the contacts; where the magnetic field increases in strength with an increase in a current through the conductors and, where the magnetic field has a minimum nonzero strength regardless of the current through the conductors.

Other objects of the invention and its particular features and advantages will become more apparent from consideration of the following drawings and accompanying detailed description.

DETAILED DESCRIPTION OF THE INVENTION

The following examples refer to circuit interrupters generally, and those having skill in the art will appreciate that the invention can be applied to various specific types of circuit interrupters such as circuit breakers and switches.

Figure 1:
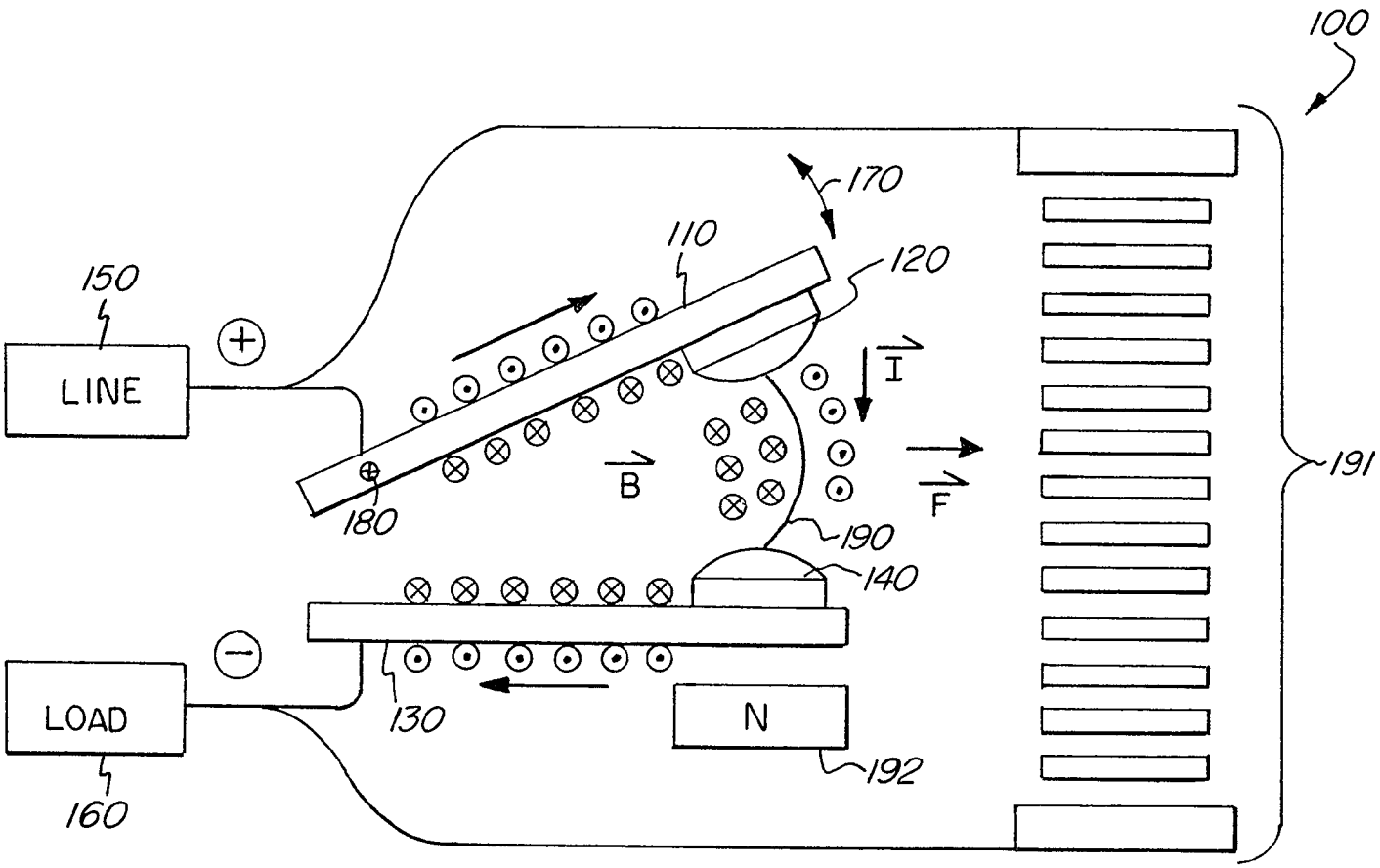
FIG. 1 illustrates portions of an example circuit breaker according to aspects of the invention.

FIG. 1 illustrates portions of an example circuit breaker 100 according to aspects of the invention.

Circuit interrupter 100 includes a first conductor 110, movable contact 120, second conductor 130, and stationary contact 140. Conductor 110 may be in electrical communication with a electric power source "line" 150 such as a generator, and conductor 130 may be in electrical communication with an electrical device "load" 160 such as a light bulb or kitchen appliance, for example. As will be appreciated by those having ordinary skill in the art and discussed further herein, this arrangement may be reversed such that conductor 110 is connected to a load, while 130 is connected to a line.

Circuit interrupter 100 operates to make and break a connection between the line and load by moving the arm such that contacts 120 and 140 either touch to form an electrical connection or separate to break the electrical connection.

In the example shown, conductor 110 and contact 120 form an arm which can swing back and forth in the direction shown by arrow 170 on a pivot 180 to make and break the electrical connection. In other implementations (not shown) different arrangements are possible without departing from the invention, such as where both contact 120 and 140 move relatively with respect to each other, or where conductor 110 bendably deflects rather than pivoting, for example.

When contacts 120 and 140 are in contact (not shown), current 180 flows from line 150 through conductor 110, movable contact 120, stationary contact 140, and conductor 130 to load 160.

When contacts 120 and 140 are separated by pivoting conductor 110 to move contact 120 to the position shown in FIG. 1, an arc 190 may travel from contact 120 to 140 such that current continues to flow.

In order to extinguish the arc, circuit interrupter 100 includes an arc quench 191. Arc quench 191 is shown implemented as an arc splitter having arc runners and a plurality of arc splitter plates, however those having ordinary skill in the art will appreciate that the arc splitter may be arranged differently from the illustration, or that other types of arc extinguishing features may be used in addition to or instead of an arc splitter without departing from the invention.

The current flowing through conductor 110 and 130 from line 150 to load 160 gives rise to a magnetic field surrounding each conductor as shown in the figure. Because conductors 110 and 130 are arranged such that the current flows in opposing directions as shown, their effects combine to result in a concentrated net magnetic flux B in the vicinity of arc 190 which flows in the direction travelling into the page.

Magnetic flux B interacts with arc 190 to create an orthogonal force F on arc 190 which urges arc 190 toward arc quench 191.

In addition to the magnetic field produced by the current flowing through conductors 110 and 130, a permanent magnet 192 is disposed and oriented to generate a magnetic flux in the vicinity of arc 190 that reinforces the net magnetic flux B.

This can have the advantage of providing a baseline level of magnetic flux B in the vicinity of arc 190 even in conditions of low current, where the magnetic field due to current flowing through conductors 110 and 130 would be lower.

Figure 2:
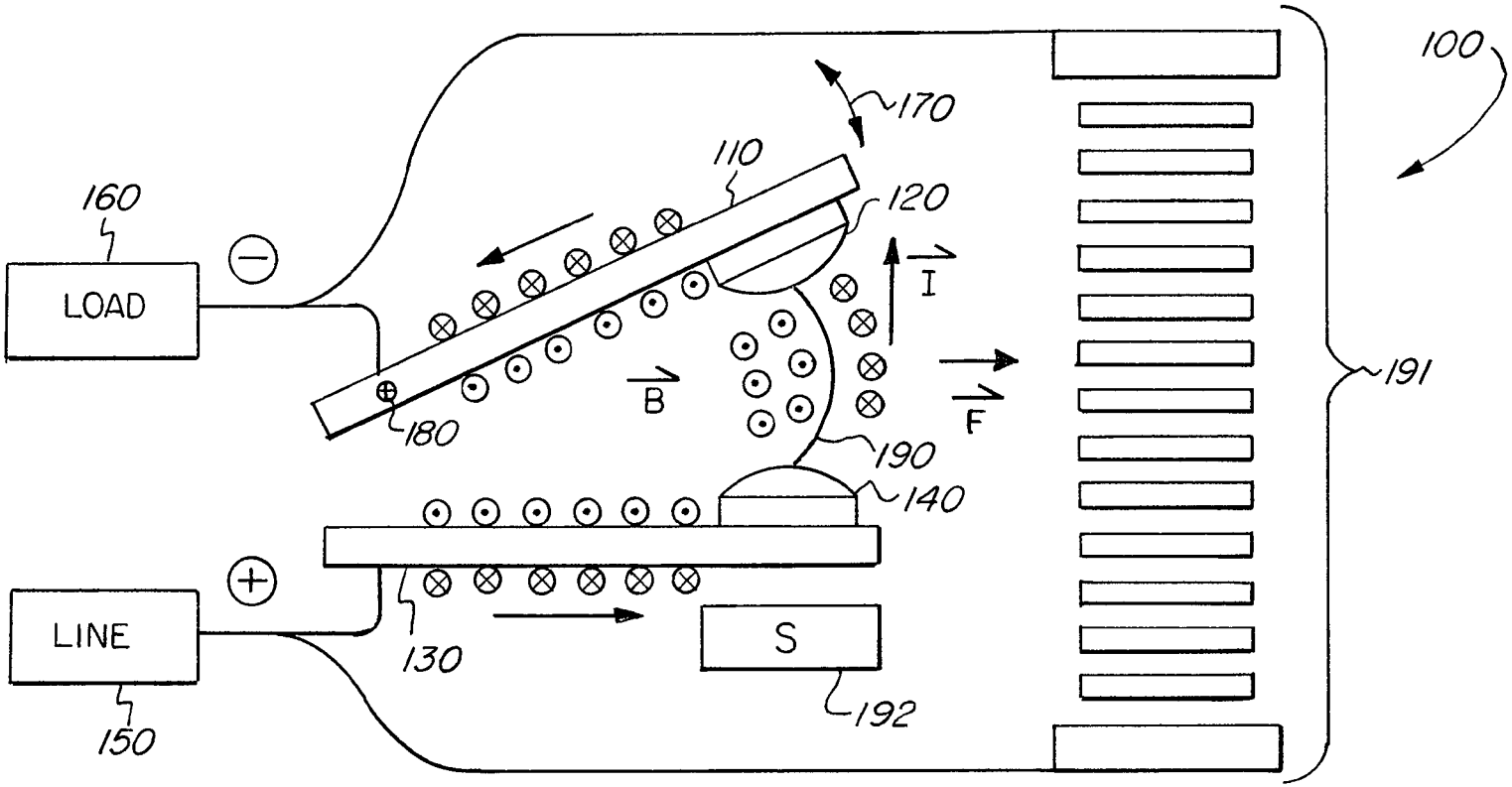
FIG. 2 illustrates portions of the example circuit breaker of FIG. 1, where the electrical polarity is reversed.

FIG. 2 illustrates portions of example circuit breaker 100 having the electrical polarity reversed with respect to FIG. 1, where line source 150 is connected to conductor 130 and load 160 connected to conductor 110.

When contacts 120 and 140 are in contact (not shown), current 180 flows from line 150 through conductor 130, stationary contact 140, movable contact 120, and conductor 110 to load 160.

When contacts 120 and 140 are separated by pivoting conductor 110 to move contact 120 to the position shown in FIG. 2, an arc 190 may travel from contact 140 to contact 120 such that current continues to flow.

The current flowing through conductor 110 and 130 from line 150 to load 160 gives rise to a magnetic field surrounding each conductor as shown in the figure.

Because conductors 110 and 130 are arranged such that the current flows in opposing directions as shown, their effects combine to result in a concentrated net magnetic flux B in the vicinity of arc 190 which flows in the direction travelling out of the page.

Magnetic flux B interacts with arc 190 to create an orthogonal force F on arc 190 which urges arc 190 toward arc quench 191.

It can be seen in FIG. 2 that both the direction of arc 190 and the direction of net magnetic flux B are opposite to their respective directions shown in the arrangement of FIG. 1. This is due to the reverse in electrical polarity of the circuit interrupter 100. However the resulting force F on arc 190 in the arrangement of FIG. 2 is in the same direction as in the arrangement of FIG. 1; i.e., toward the arc quench 191.

In addition to the magnetic field produced by the current flowing through conductors 110 and 130, permanent magnet 192 is disposed and oriented to generate a magnetic flux in the vicinity of arc 190 that reinforces the net magnetic flux B.

This can have the advantage of providing a baseline level of magnetic flux B in the vicinity of arc 190 even in conditions of low current, where the magnetic field due to current flowing through conductors 110 and 130 would be lower.

Note, the permanent magnet 192 is shown oriented opposite to its orientation in FIG. 1. The permanent magnet 192 is constructed such that it can pivot about an axis or otherwise orient (or reorient) itself according to the magnetic flux due to the current through the conductors.

Thus in both FIG. 1 and FIG. 2, the magnetic field produced by permanent magnet 192 in the vicinity of arc 190 is additive with the magnetic field produced by the current flowing through conductors 110 and 130, even though the direction of this magnetic field reverses with the electrical polarity of circuit interrupter 100.

This can have the advantage of providing a baseline level of force on any arc 190 to urge it toward arc quench 191, regardless of either the direction in which current flows through circuit interrupter 100 or the magnitude of the current.

Figure 3A:
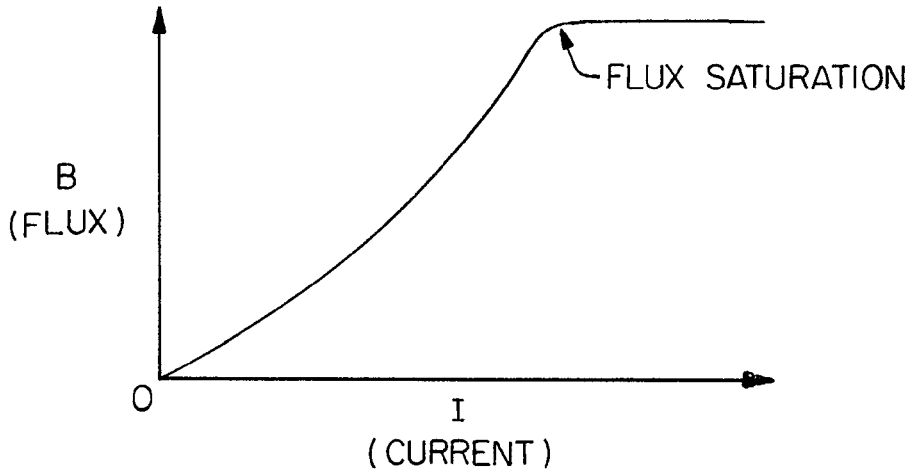
FIGS. 3A and 3B are graphs illustrating the relationship between current through the circuit breaker and magnetic flux in a circuit breaker similar to FIGS. 1 and 2 with and without a permanent magnet respectively.
Figure 3B:
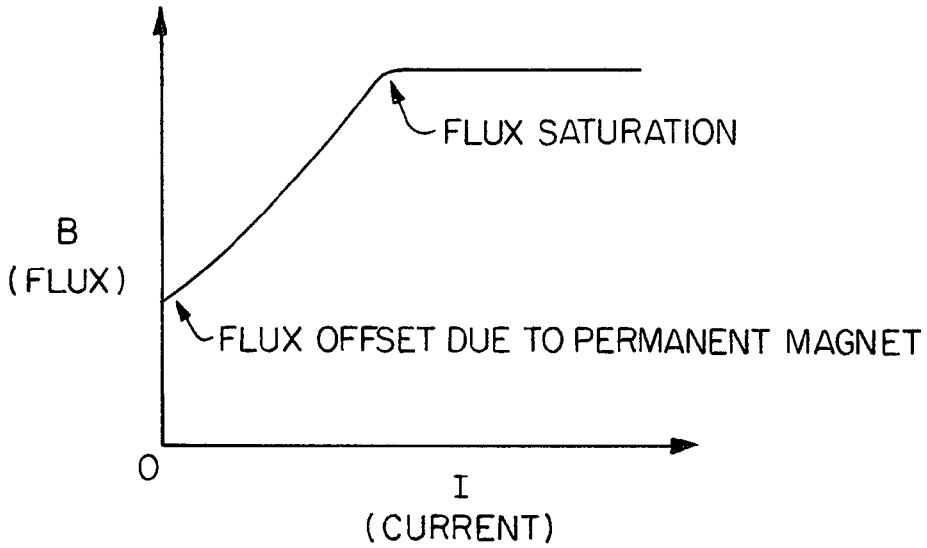

FIGS. 3A and 3B are graphs which illustrate this baseline magnetic flux, which is an advantage of adding a re-orientable permanent magnet to an electromagnetically assisted arc extinguisher as shown in figures A and B.

FIG. 3A shows a graph of the magnitude of magnetic flux B with respect to current I through a circuit interrupter that is arranged similarly to circuit interrupter 100 to generate a magnetic field due to the current, but which does not include a permanent magnet.

As can be seen in the figure, the magnitude of flux B has a minimum of zero at zero current, and increases with current until it asymptotically approaches a level of flux saturation.

In some applications of such a circuit, there may be a level of current where arcing occurs in the interrupter but where the flux is too low to sufficiently urge the arc into the arc arresting structure.

FIG. 3B shows a graph of the magnitude of magnetic flux B with respect to current through a circuit interrupter that is arranged similarly to circuit interrupter 100 to generate a magnetic field due to the current, and which also includes a permanent magnet.

As can be seen in the figure, the magnitude of flux B has a minimum nonzero baseline at zero current due to the field produced by the permanent magnet, and which increases with current until it asymptotically approaches a level of flux saturation.

In some applications of such a circuit, the baseline flux provided by the permanent magnet compensates for situations where the flux produced electromagnetically in the circuit interrupter would be too low itself to sufficiently urge an arc into the arc arresting structure.

Figure 4B:
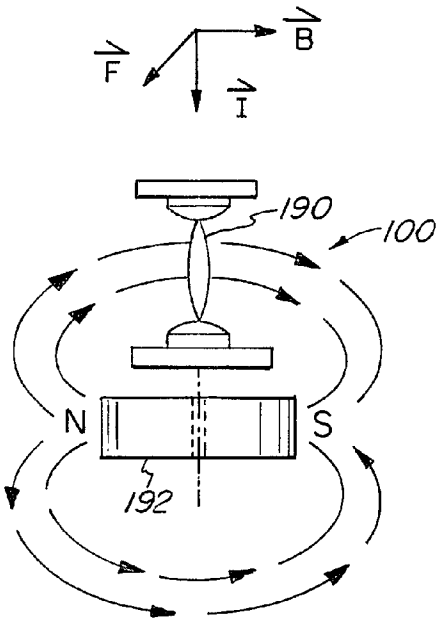
FIGS. 4A, 4B, and 4C are side, front, and top views respectively of portions of the example circuit interrupter as shown in FIG. 1.
Figure 4A:
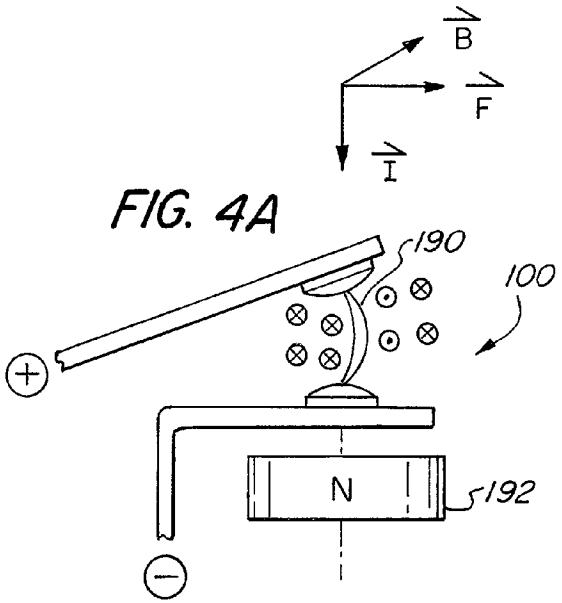
Figure 4C:
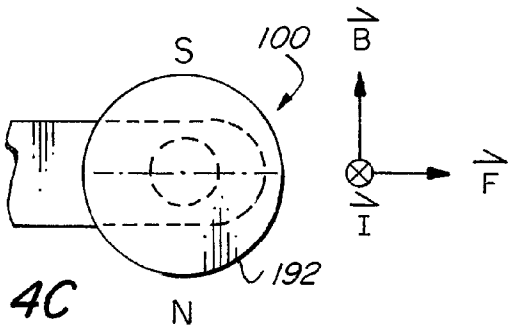

FIGS. 4A, 4B, and 4C are side, front, and top views respectively of portions of the example circuit interrupter 100 with current flow as shown in FIG. 1, further illustrating the interaction of the magnetic field produced by permanent magnet 192 with arc 190 and also showing the orthogonal relationship of the arc current, net magnetic field, and force vectors of this arrangement.

Figure 5B:
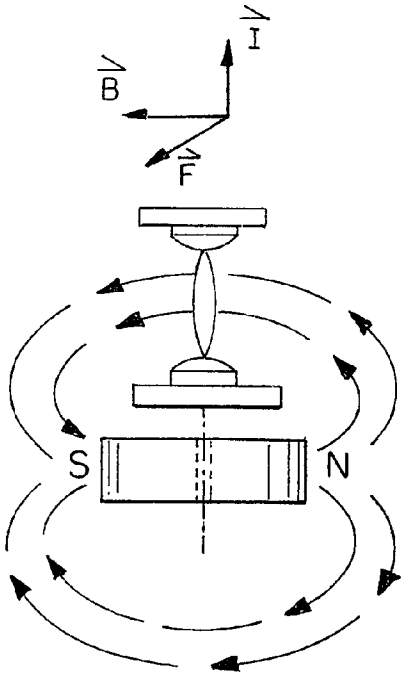
FIGS. 5A, 5B, and 5C are side, front, and top views respectively of portions of the example circuit interrupter as shown in FIG. 2.
Figure 5A:
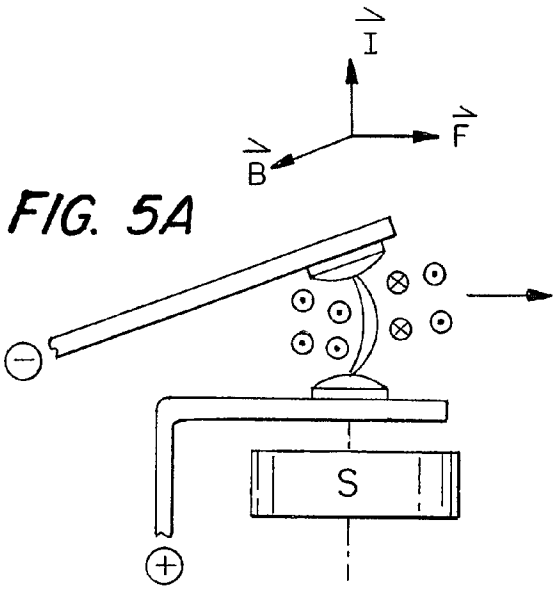
Figure 5C:
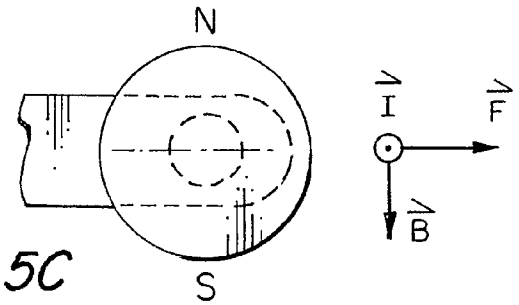

FIGS. 5A, 5B, and 5C are side, front, and top views respectively of portions of the example circuit interrupter 100 with current flow as shown in FIG. 2, further illustrating the interaction of the magnetic field produced by permanent magnet 192 with arc 190 and also showing the orthogonal relationship of the arc current, net magnetic field, and force vectors of this arrangement.

Figure 6:
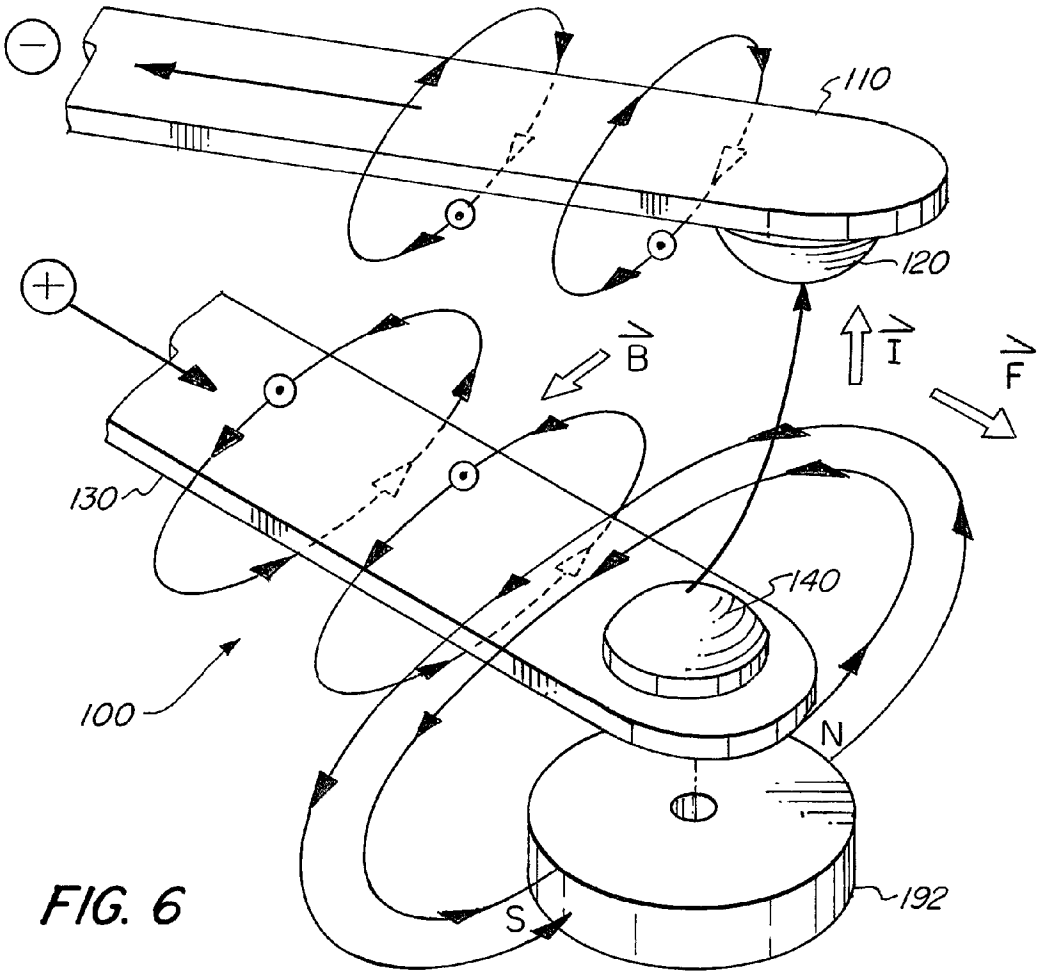
FIG. 6 is a three-dimensional view of portions of the example circuit interrupter as shown in FIGS. 2, 5A, 5B, and 5C.

FIG. 6 is a three dimensional view of portions of the example circuit interrupter 100 with current flow as shown in FIGS. 2 and 5A, 5B, and 5C.

Figure 7A:
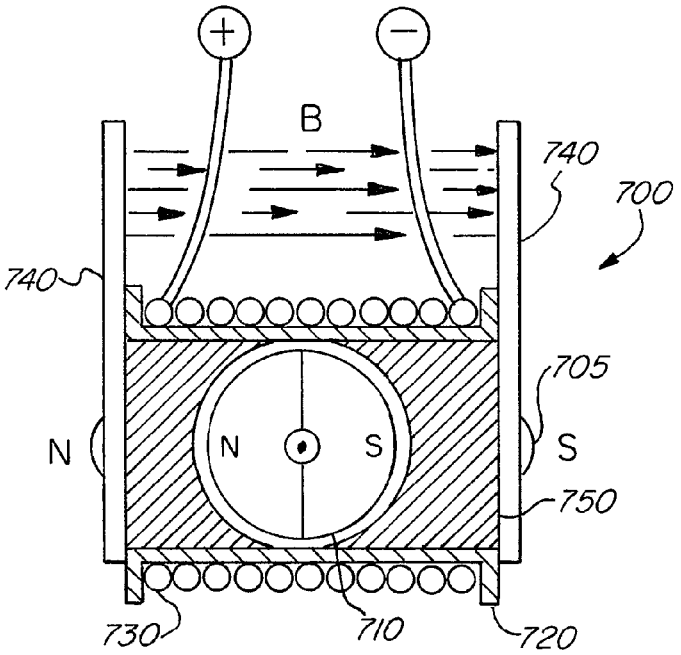
FIGS. 7A and 7B illustrate an example magnetic structure usable with a circuit interrupter such as illustrated in FIG. 1.
Figure 7B:
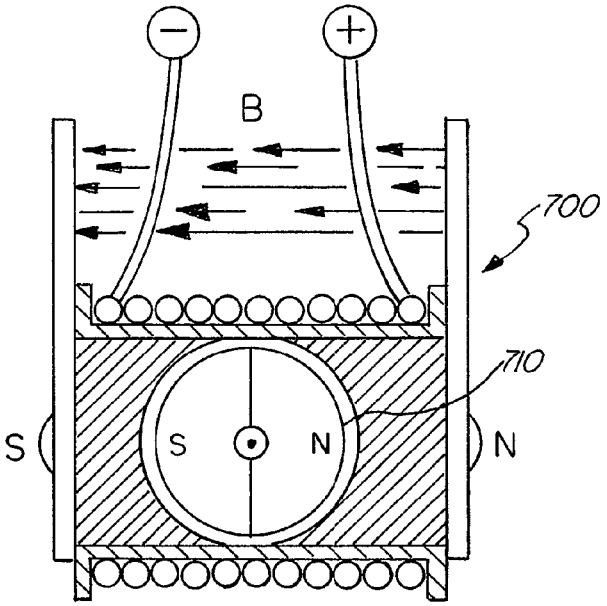

FIGS. 7A and 7B illustrate example implementation of another magnet structure 700 according to aspects of the invention.

Magnet structure 700 is a combination electromagnet and permanent magnet, which includes a pivotable permanent magnet 710, and an electromagnet 705 within which permanent magnet 710 is pivotably disposed.

Permanent magnet 710 may be a diametrically polarized magnet having pivot structures, and may be substantially similar to magnet 192 as shown and described with respect to FIGS. 1-6.

Electromagnet 705 is of a typical solenoid type having a bobbin 720, windings 730, pole pieces 740, and a core 750. Permanent magnet 710 is pivotably disposed within core 750.

When electromagnet 705 is energized as shown in FIG. 7A, permanent magnet 710 pivotably orients within the magnetic field produced by electromagnet 705 such that a magnetic field produced by permanent magnet 710 is additive with the magnetic field produced by electromagnet 705.

The combined magnetic field B flows between pole pieces 740 in the direction shown.

When electromagnet 705 is energized as shown in FIG. 7B, permanent magnet 710 pivotably orients within the magnetic field produced by electromagnet 705 such that a magnetic field produced by permanent magnet 710 is additive with the magnetic field produced by electromagnet 705.

The combined magnetic field B flows between pole pieces 740 in the direction shown, which is opposite to the direction of flow shown in FIG. 7A.

Figure 8:
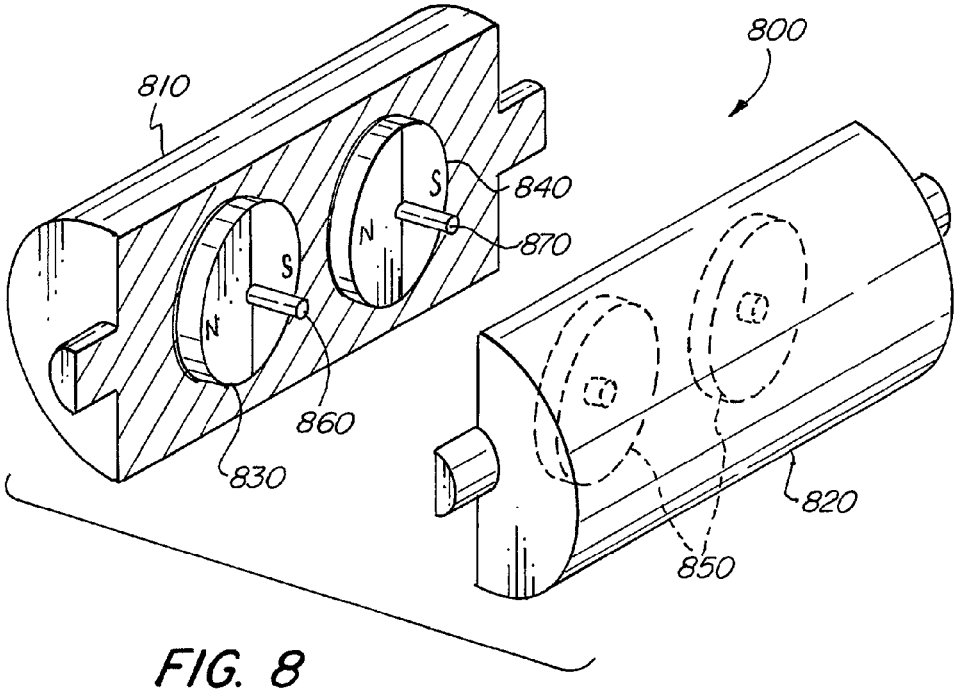
FIG. 8 is a partially exploded view of an example core assembly usable with the magnetic structure of FIGS. 7A and 7B.

FIG. 8 is a partially exploded view of an example core assembly 800 according to aspects of the invention. Core assembly 800 is similar to the combination of core 750 and permanent magnet 710 shown and described with respect to FIGS. 7A and 7B, and in some implementations is interchangeable with those components.

Core assembly 800 includes core halves 810 and 820, and permanent magnets 830 and 840.

Core halves 810 and 820 may be made with any suitable material used in solenoid cores, and include recesses 850 to accommodate permanent magnets 830 and 840.

Permanent magnets 830 and 840 are substantially similar to permanent magnet 710, and include pivots 860 and 870.

When core assembly 800 is assembled and installed in a solenoid electromagnet, the electromagnet will function in a similar manner as magnet structure 700 shown and described with respect to FIGS. 7A and 7B.

Using two permanent magnets within a core of a solenoid in this way can have the advantage of increasing the amount of magnetic flux contributed to the structure by permanent magnets, which can increase the baseline magnetic flux as shown and described with respect to FIG. 3B.

Figure 9:
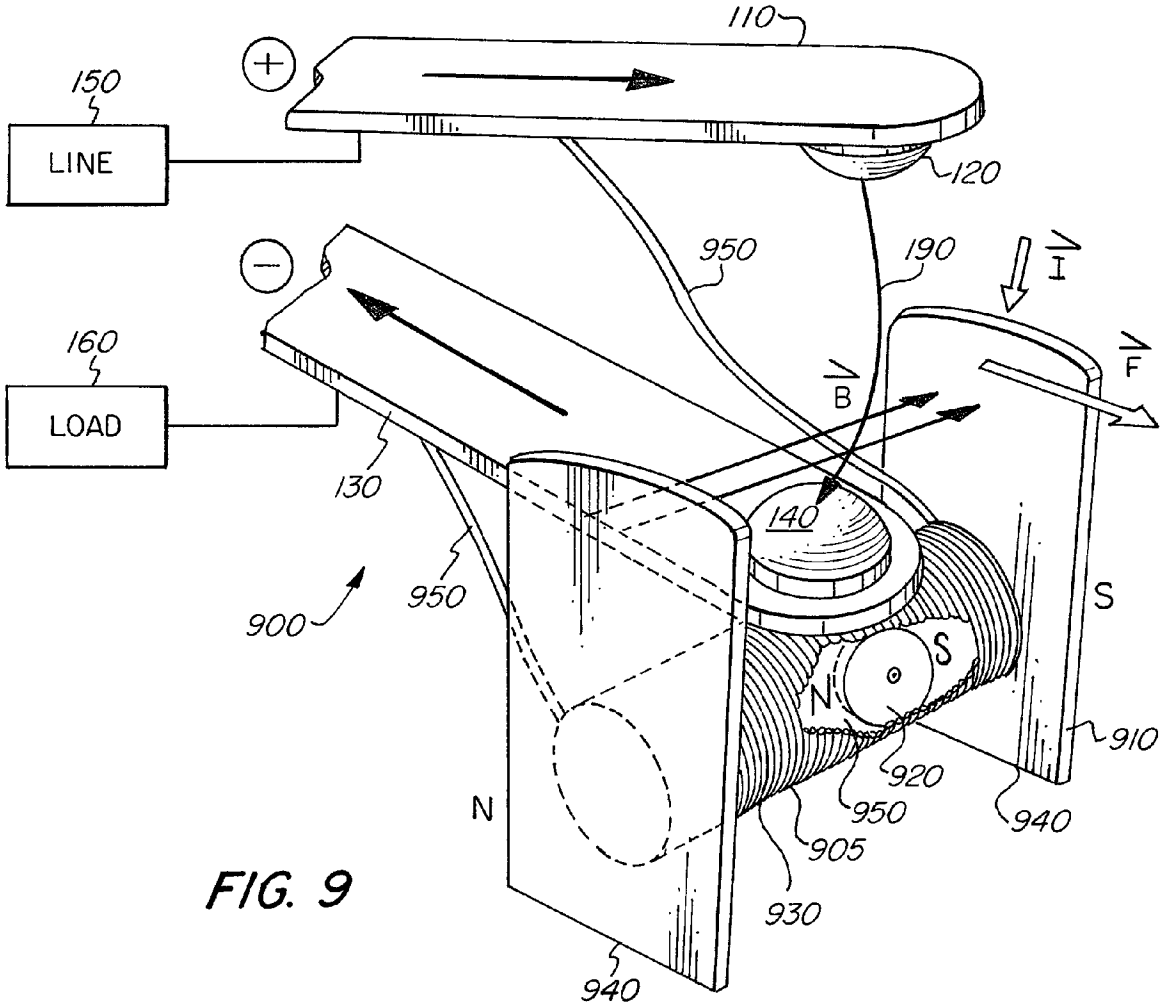
FIG. 9 is a three-dimensional view of portions of an example circuit breaker as shown in FIG. 1 incorporating the magnet structure of FIG. 7.

FIG. 9 is a three dimensional partial cutaway view which shows portions of an example circuit interrupter 900 according to aspects of the invention.

Circuit interrupter 900 is similar to circuit interrupter 100 shown and described with respect to FIGS. 1-6, except in that the permanent magnet 192 has been replaced with a magnet unit 910 that is substantially similar to magnet unit 700, shown and described with respect to FIGS. 7A and 7B.

Magnet unit 910 is a combination electromagnet and permanent magnet, which includes an electromagnet 905 within which a permanent magnet 920 is pivotably disposed.

Permanent magnet 920 may be a diametrically polarized magnet having pivot structures, and may be substantially similar to magnet 192 as shown and described with respect to FIGS. 1-6.

Electromagnet 905 is of a typical solenoid type having windings 930, pole pieces 940, and a core 950. Permanent magnet 920 is pivotably disposed within core 950.

When electromagnet 905 is energized by its connections 950 to conductors 130 and 110 as shown in FIG. 9, permanent magnet 920 pivotably orients within the magnetic field produced by electromagnet 905 such that a magnetic field produced by permanent magnet 920 is additive with the magnetic field produced by electromagnet 905.

The combined net magnetic flux B flows between pole pieces 940 in the direction shown.

It should be noted that because conductors 110 and 130 are arranged such that the current flows in opposing directions as shown, their effects combine to result in a concentrated additional magnetic flux that is additive with net magnetic flux B in the vicinity of arc 190. However for clarity, this magnetic flux has not been illustrated in FIG. 9.

Net magnetic flux B interacts with arc 190 to create an orthogonal force F on arc 190 which urges arc 190 toward an arc quench (not shown).

Figure 10:
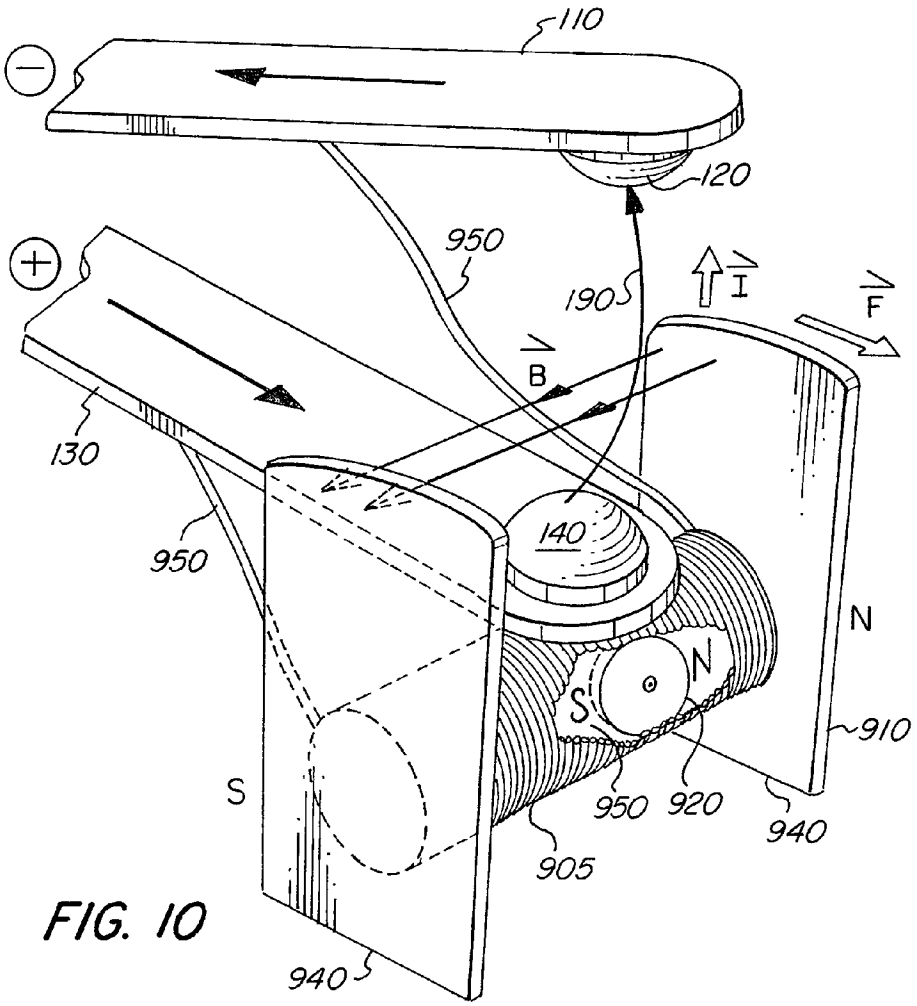
FIG. 10 is a three dimensional view of portions of the example circuit breaker shown in FIG. 9, having its electrical polarity reversed.

FIG. 10 is a three dimensional partial cutaway view which shows the portions of example circuit interrupter 900 described with respect to FIG. 9, having its electrical polarity reversed.

Here, when electromagnet 905 is energized by its connections 950 to conductors 130 and 110, permanent magnet 920 pivotably orients within the magnetic field produced by electromagnet 905 such that a magnetic field produced by permanent magnet 920 is additive with the magnetic field produced by electromagnet 905.

The combined net magnetic flux B flows between pole pieces 940 in the direction shown, which is opposite in direction to the corresponding flux in the arrangement of FIG. 9.

It should be noted that because conductors 110 and 130 are arranged such that the current flows in opposing directions as shown, their effects combine to result in a concentrated additional magnetic flux that is additive with net magnetic flux B in the vicinity of arc 190. However for clarity, this magnetic flux has not been illustrated in FIG. 10.

Net magnetic flux B interacts with arc 190 to create an orthogonal force F on arc 190 which urges arc 190 toward an arc quench (not shown). The force F has the same direction as the corresponding force in the arrangement of FIG. 9.

Figure 11:
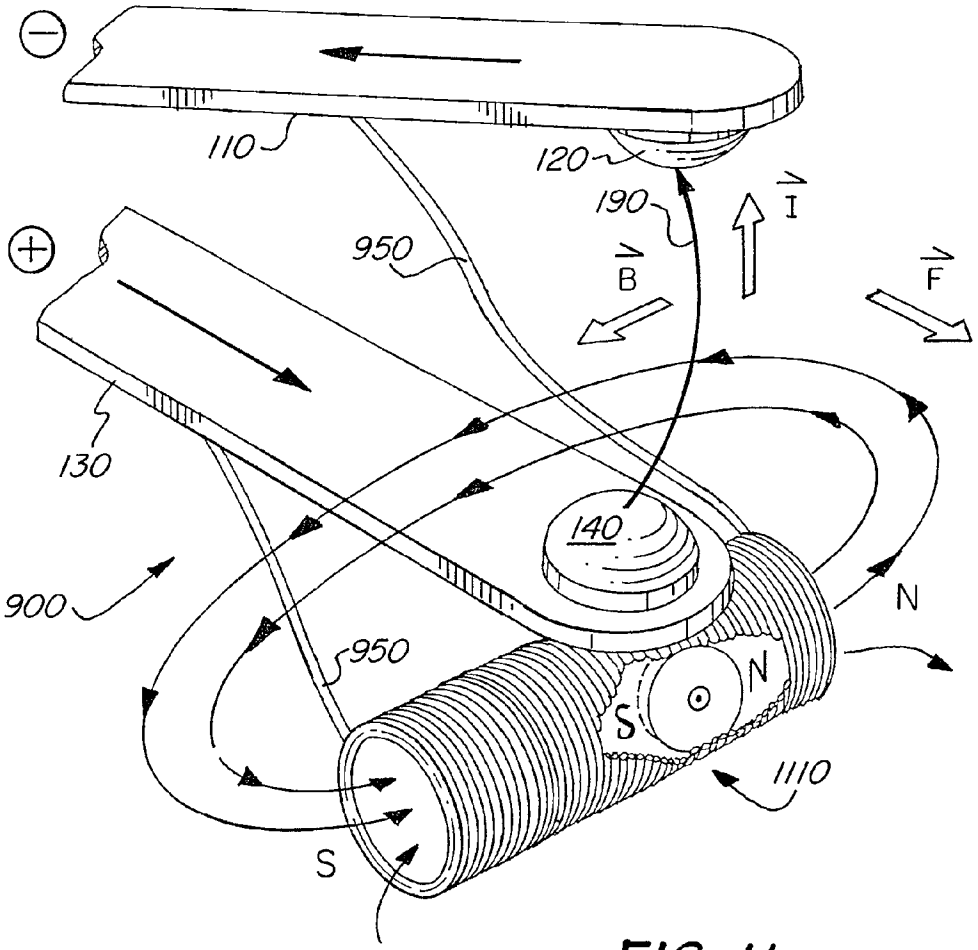
FIG. 11 is a three dimensional view of portions of the example circuit breaker of FIGS. 9 and 10, including an alternate magnet unit.

FIG. 11 is a three dimensional partial cutaway view which shows the portions of example circuit interrupter 900 as shown and described with respect to FIGS. 9 and 10, except that magnet unit 910 has been replaced with a magnet unit 1110.

Magnet unit 1110 is substantially similar to magnet unit 910 except in that it omits pole pieces 940. This omission of the pole pieces results in a different distribution of magnetic flux between the poles of magnet unit 1110 as compared to FIGS. 9 and 10, however, the direction of net force vector F remains the same as in FIGS. 9 and 10.

As in FIGS. 9 and 10, it should be noted that because conductors 110 and 130 are arranged such that the current flows in opposing directions as shown, their effects combine to result in a concentrated additional magnetic flux that is additive with net magnetic flux B in the vicinity of arc 190. However for clarity, this magnetic flux has not been illustrated in FIG. 11.

Also as in FIGS. 9 and 10, the net force represented by vector F urges arc 190 toward an arc extinguishing structure (not shown) regardless of the electrical polarity of the circuit.

Using a simplified magnet unit 1110 in this way can have the advantage of reducing costs of manufacture or of simplifying design.

Figure 12:
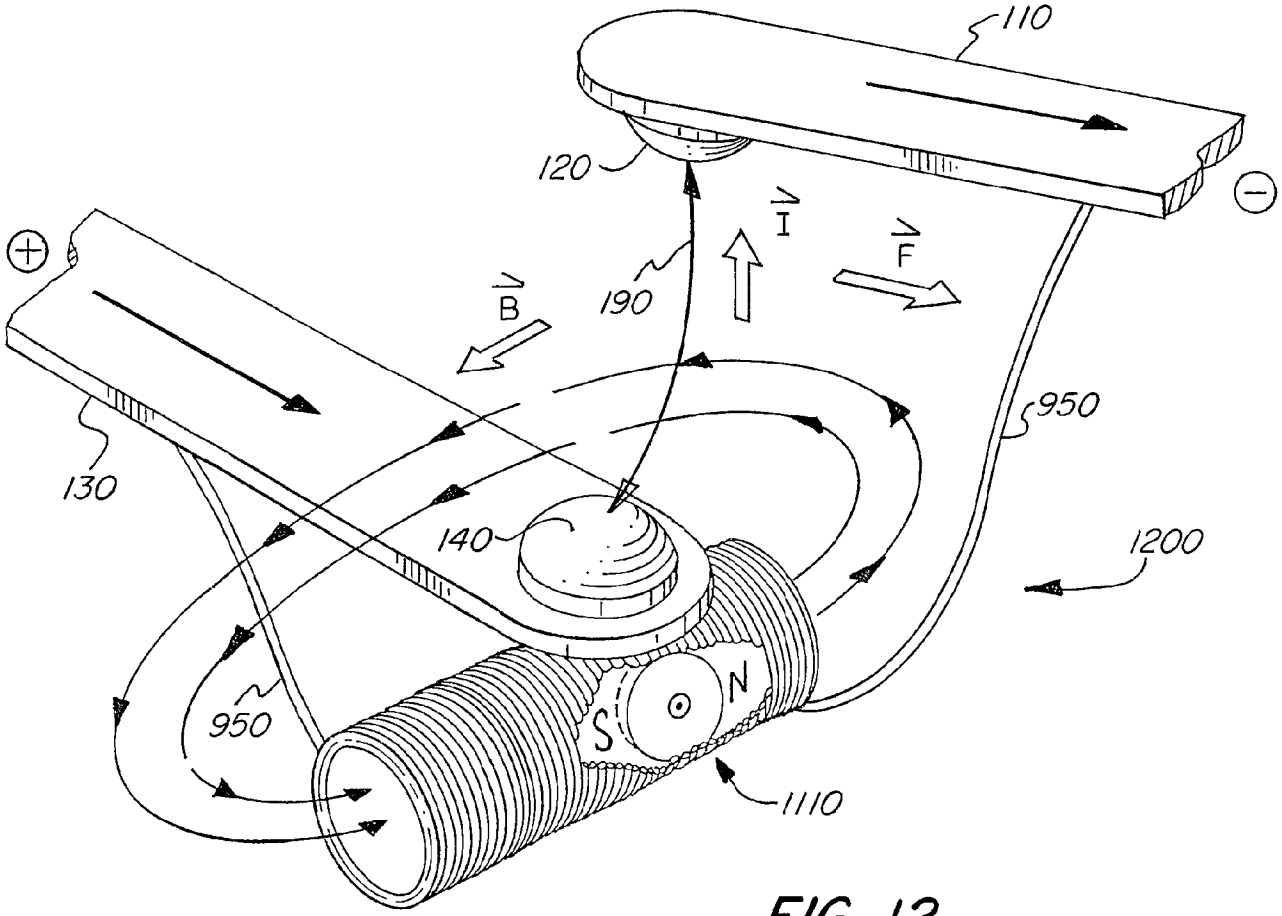
FIG. 12 is a three dimensional view of portions of an example circuit breaker similar to FIGS. 10 and 11, having an alternate arrangement of electrical conductors.

FIG. 12 is a three dimensional partial cutaway view which illustrates an example circuit interrupter 1200 that is substantially similar to circuit interrupter 900 as shown and described with respect to FIG. 11, except that conductor 110 extends in the opposite direction.

Circuit interrupter 1200 functions similarly to circuit interrupter 900 as shown and described with respect to FIG. 11, except that because conductors 110 and 130 are not arranged such that the current flows in opposing directions as shown, the magnetic fields (not shown) due to the current in conductors 110 and 130 are not concentrated in the vicinity of arc 190. However, net magnetic flux B still interacts with arc 190 to create a net orthogonal force F which urges arc 190 toward an arc extinguisher (not shown) regardless of the electrical polarity of the circuit.

Although the invention has been described with reference to a particular arrangement of parts, features and the like, these are not intended to exhaust all possible arrangements or features.

For example, although certain example implementations described herein refer to solenoid type electromagnets, those having skill in the art will appreciate that the invention may be applied to other types of electromagnetic structures. Additional modifications and variations may also be ascertainable to those of skill in the art without deviating from the invention.

What is claimed is:

1. A circuit interrupter comprising:

a first contact:

a second contact;

wherein at least one of said first or said second contact is movable with respect to the other contact;

a first conductor electrically connected to the first contact;

a second conductor electrically connected to the second contact;

an arc extinguisher;

an electromagnetic structure disposed to guide an arc that develops between the contacts toward said arc extinguisher; and, a permanent magnet disposed within a core of the electromagnetic structure;

wherein said permanent magnet pivotably orients with respect to an electromagnetic field produced by the electromagnetic structure; and, wherein the permanent magnet is disposed to guide the arc toward the arc extinguisher regardless of the polarity of the contacts.

2. A circuit interrupter comprising:

a first contact and a second contact, at least one of which is movable with respect to the other;

a first conductor electrically connected to the first contact;

a second conductor electrically connected to the second contact;

an arc extinguisher;

an electromagnetic structure disposed to guide an arc that develops between the contacts toward said arc extinguisher; and a permanent magnet disposed to guide the arc toward said arc extinguisher regardless of the polarity of the contacts.

3. The circuit interrupter of claim 2, wherein the permanent magnet is at least partly disposed within the electromagnetic structure.

4. The circuit interrupter of claim 2, wherein the permanent magnet is oriented by an electromagnetic field.

5. The circuit interrupter of claim 4, wherein the electromagnetic field is produced by the electromagnetic structure.

6. The circuit interrupter of claim 2, wherein the permanent magnet is disposed such that a field of the permanent magnet flows through an area where the first contact and second contact move into and out of contact with each other.

7. The circuit interrupter of claim 2, wherein the electromagnetic structure comprises an electromagnet.

8. The circuit interrupter of claim 2, wherein the electromagnetic structure comprises a conductor wrapped around a core.

9. The circuit interrupter of claim 8, wherein the permanent magnet is disposed within the core.

10. The circuit interrupter of claim 8, wherein the permanent magnet is pivotable within the core.

11. The circuit interrupter of claim 2, wherein an electromagnetic field produced by the electromagnetic structure can orient the permanent magnet.

12. The circuit interrupter of claim 2, wherein the electromagnetic structure comprises the first electrical conductor and the second electrical conductor.

13. The circuit interrupter of claim 12, wherein a current flowing through said first conductor runs in a direction substantially opposite to a direction in which the current flows through said second conductor.

14. The circuit interrupter of claim 12 wherein the current flowing through said first conductor, said first contact, said second contact, and said second conductor generates a magnetic force which urges the arc toward said arc extinguisher.

15. A circuit interrupter comprising:

a first contact and a second contact, at least one of which is movable with respect to the other;

a first conductor electrically connected to the first contact;

a second conductor electrically connected to the second contact;

an arc extinguisher; and, a magnetic field generating structure configured and adapted to generate a magnetic field that guides an arc that develops between the contacts toward said arc extinguisher regardless of a polarity of the contacts;

wherein the magnetic field increases in strength with an increase in a current through the conductors; and, wherein the magnetic field has a minimum nonzero strength regardless of the current through the conductors.

* * * * *